United States Patent [19]

Bucknall

[11] 4,123,041

[45] Oct. 31, 1978

[54] LIFTING TACKLE

[76] Inventor: Arthur H. Bucknall, Ventnor Cottage, Sough Rd., Darwen, Lancaster, England

[21] Appl. No.: 815,022

[22] Filed: Jul. 12, 1977

[51] Int. Cl.[2] ..... B66D 3/08

[52] U.S. Cl. ..... 254/195; 29/428

[58] Field of Search ..... 29/428, 159 R, 700; 254/188, 192, 194, 195, 4 R, 4 C, 190 R, 142; 74/230.01, 230.3; 52/122, 721; 294/85; 248/72, 228

[56] References Cited

U.S. PATENT DOCUMENTS

| | | | |
|---|---|---|---|
| 947,441 | 1/1910 | Hankin et al. | 248/72 |
| 1,955,942 | 4/1934 | Bush | 254/190 R |
| 2,307,681 | 1/1943 | Kalmbach | 254/142 |
| 2,841,020 | 7/1958 | Van Deventer | 74/230.01 |
| 3,561,717 | 2/1971 | Frederick et al. | 294/85 |
| 4,019,705 | 4/1977 | Habuda, Sr. | 248/228 |

FOREIGN PATENT DOCUMENTS

| | | | |
|---|---|---|---|
| 517,071 | 10/1955 | Canada | 254/195 |

*Primary Examiner*—Michael J. Keenan

*Attorney, Agent, or Firm*—Norris & Bateman

[57] ABSTRACT

A method and lifting tackle for raising a load into contact with the underside of an I section girder or beam to allow the brackets of each pair to rest together on assembly on small girders.

2 Claims, 6 Drawing Figures

LIFTING TACKLE

This invention relates to improvements in lifting tackle.

When using chain blocks and tackle or pulley blocks for lifting beams and girders into position and for lifting loads, difficulty is experienced due to swinging of the blocks with consequent dislocation of the chains or ropes and furthermore the beams or girders have to be positioned after lifting.

The object of the invention is to provide a tackle which can be rigidly positioned on the flange of a girder and which will lift the load accurately into any required position.

According to the invention a method for raising a load into contact with the underside of an I section girder or beam of a structure comprising mounting V notched brackets in pairs on the upper flange of the I girder, passing a cord or chain over a pair of pulleys in each bracket of the pair with one end of the cord or chain depending from each bracket, affixing the load to one depending end of the cord or chain and raising the load into contact with the lower flange of the I girder by applying tension to the other end of the cord or chain.

A lifting tackle for carrying out the method in which pairs of brackets are mounted on the upper flange of an I girder or beam each bracket comprising side cheeks recessed to form a V notch, the upper edge of the notch being substantially horizontal to grip the upper surface of the upper flange of the girder or beam and the lower edge angled to engage the under edge of the top flange and a pair of pulleys mounted on a spindle passing through the cheeks with a cord or chain passing over the pulleys on the pair of brackets with one end of the cord or chain depending from each bracket for attachment of the load to one depending cord or chain and applying tension to the other depending end to raise the load.

The invention will be described with reference to the accompanying drawings.

Figure 1:
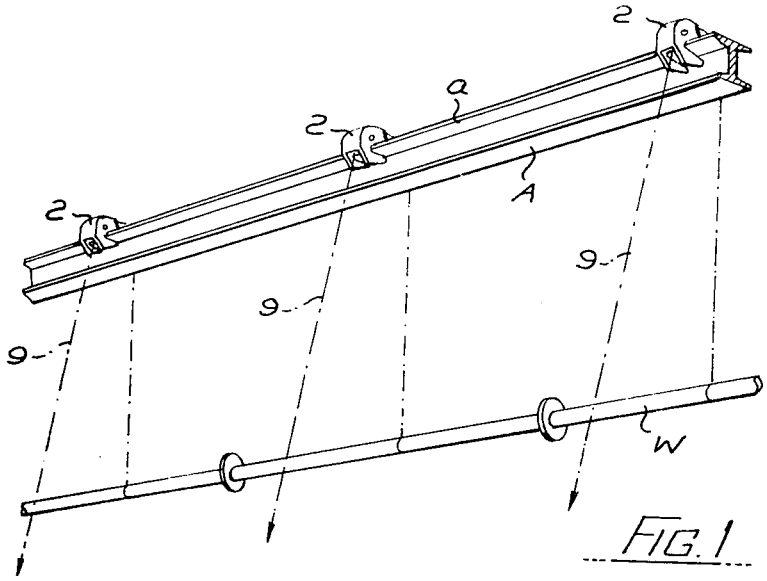
FIG. 1 is a perspective view showing pipes being lifted into position below the girder.
Figure 2:
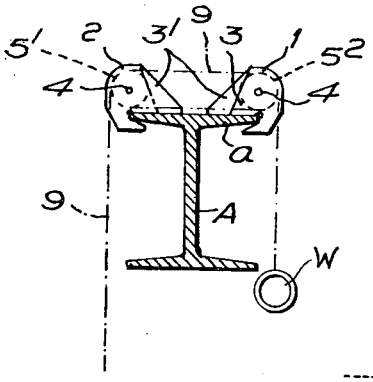
FIG. 2 is a transverse section showing a pipe lifted into position below the girder.
Figure 3:
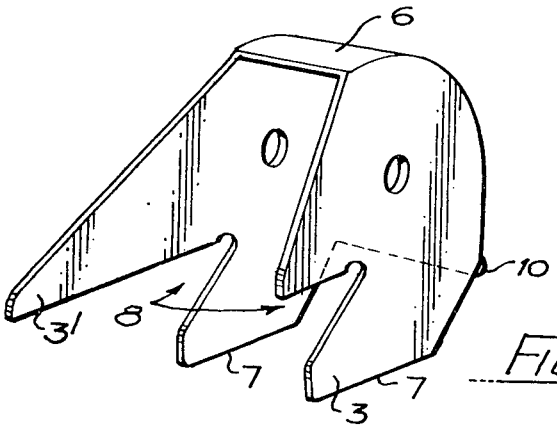
FIG. 3 is a perspective view of one lifting bracket.

A lifting tackle is constructed with a pair of brackets 1, 2 each bracket comprising a pair of side cheeks 3, $3^1$ between which are rotatably mounted on a spindle 4 side by side, two chain or rope pulleys of equal diameter.

The side cheeks are spaced apart by a web or webs 6 and the lower surface 7 of the side cheeks is preferably formed to rest in a horizontal plane. The web 6 is preferably formed integrally with the cheeks. Alternatively the cheek plates may be separated by rods which also act as rope guides.

One edge of each of the side cheeks 3 is recessed to form a V notch 8, the upper edge of each notch being horizontal for engagement with a flange *a* on a girder A, the two brackets 1, 2 being mounted thereon with the V notches 8 each engaging opposite edges of the flange *a*. The V notches preferably diverge at an angle to say 35° and are formed with a recess between the two limbs.

Figure 6:
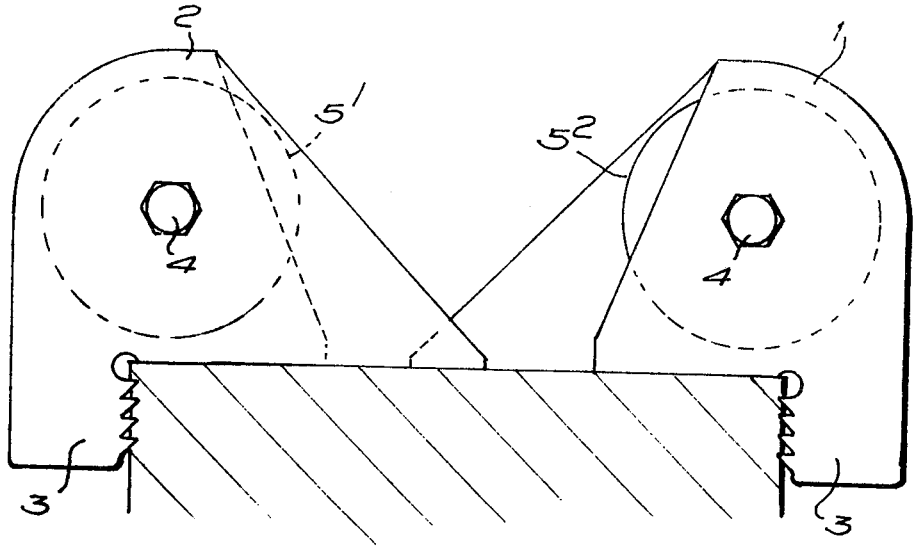
FIG. 6 is a section of a bracket applied to a wooden beam.

FIG. 6 shows the bracket applied to a wooden beam in which the lower limb of the side cheek 3 is at an angle of 90° to the upper limb and is serrated to grip the wood.

The web 6 acts as a guide or guard to retain the rope or chain 9 on the pulleys. The free ends of the rope or chain 9 hang down from the brackets over a cylindrical rod or rollers 10 which prevent the rope or chain from being damaged during raising or lowering the load.

Figure 4:
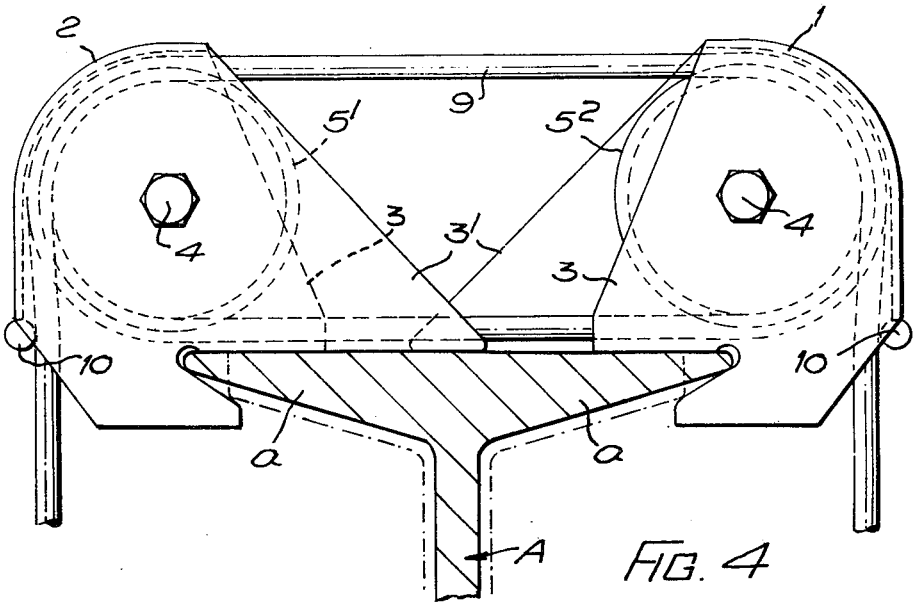
FIG. 4 is a side elevation of two lifting brackets in position on a girder (shown in sections).
Figure 5:
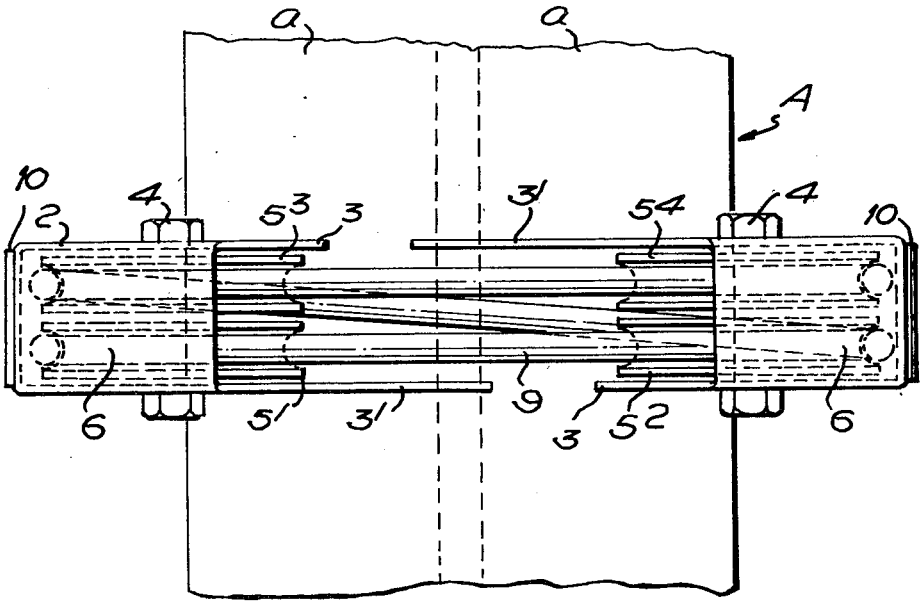
FIG. 5 is a plan view of FIG. 4.

One limb of the cheeks $3^1$ extends forwardly of the other cheek 3 to allow the brackets to nest together for employment on small girders as shown in FIG. 4. According to the width and thickness of the flange the lower limb will engage the underside of the flange at some point and pivot about this point to maintain the horizontal face of the upper limb to close contact with the upper face of the flange.

In use, the brackets 1, 2 are mounted overslung on the upper flange *a* of a girder A in a building with the rope or chain 9 for raising a load depending from one bracket 2 and passing over one pulley $5^1$ on the first bracket 2 and over a pulley $5^2$ on the second bracket 1, down and under the second pulley $5^3$ on the bracket 2 and finally up and over the second pulley $5^4$ on the bracket 1 to hang vertically therefrom.

By attaching a load W to one of the depending ends of the rope or chain 9 and applying tension to the other depending end of the rope or chain, the two pairs of pulleys tend to be drawn together with a force equal to three times the weight of the load being raised and thus the sides of the notches are firmly held in contact with the flange of the girder by pivot action on the lower edge of the flange and the load is then raised.

For lifting a second girder or a pipe W into contact with the girder A already in position, two sets of tackle 1, 2, may be employed one adjacent each end of the girder or pipe to be lifted, or three or more sets of tackle may be employed as shown in FIG. 1.

Alternatively a rope or chain block may be connected to one depending end of the rope or chain and operated to lift the load. This construction is particularly applicable for raising heavy loads in which the bracket is carried by a frame resting on the upper flange of the girder A and extending under the top flange *a* thereof. The rope or chain for raising the load is attached to the hook of a chain block or pull-lift with means for holding the load in the raised position.

The load when raised into contact with the girder A in position can be held manually or otherwise in this position during the securing of a second girder to the first girder.

The position of the brackets 1, 2 may be accurately determined before the load is raised by sliding the brackets along the flange of the first girder A to the required position.

Alternatively the brackets may be affixed to channel members or wooden or like beams.

The brackets are mounted above the top flange of the first girder and are applicable for any size of I section girder.

The fact that it is possible to also raise a load higher than the underside of the girder or beam it is being lifted from is of great assistance in easy affixing to the beam or girder and is not possible using normal lifting tackle.

The construction hereinbefore described may also be used to raise light loads, such as lengths of pipe or beams. The pipes may be joined together before lifting and by employing two or more sets of brackets with lifting tackle for each section, the pipes maybe raised to the underside of the R.S.J. beam or girder A as shown in FIG. 1.

What I claim is:

1. A lifting tackle for raising a load into contact with the underside of a flanged I section girder or beam comprising pairs of brackets adapted to be mounted in laterally opposed relation on the upper flange of the girder or beam, side cheeks on each bracket recessed to form a V notch, the upper surface of each notch being substantially horizontal to grip the upper surface of the upper flange of the girder or beam, a spindle passing through the cheeks of each bracket and pulleys mounted on each spindle, one side cheek of each bracket being extended forwardly of the other cheek to allow the brackets of each pair to nest together laterally on assembly on small girders, and a cord or chain passing over the pulleys on the pair of brackets with one end of the cord or chain depending from each bracket for attachment of the load to one depending cord or chain and for applying tension to the other depending end to raise the load.

2. A lifting tackle as in claim 1 in which a web is formed integrally with the cheeks to space the cheeks apart and to keep the cord or chain on the pulleys.

* * * * *